US008885855B2

(12) United States Patent
Van Dijk

(10) Patent No.: US 8,885,855 B2
(45) Date of Patent: Nov. 11, 2014

(54) HIGH DIRECTIVITY BOUNDARY MICROPHONE

(75) Inventor: Aldo Van Dijk, Tilburg (NL)

(73) Assignee: Robert Bosch GmbH, Stuttgart (DE)

( * ) Notice: Subject to any disclaimer, the term of this patent is extended or adjusted under 35 U.S.C. 154(b) by 170 days.

(21) Appl. No.: 13/577,695

(22) PCT Filed: Feb. 8, 2010

(86) PCT No.: PCT/EP2010/051459

§ 371 (c)(1),
(2), (4) Date: Oct. 12, 2012

(87) PCT Pub. No.: WO2011/095222

PCT Pub. Date: Aug. 11, 2011

(65) Prior Publication Data

US 2013/0039523 A1 Feb. 14, 2013

(51) Int. Cl.
*H04R 25/00* (2006.01)
*H04R 1/34* (2006.01)

(52) U.S. Cl.
CPC ..... *H04R 1/342* (2013.01)
USPC ..... 381/313; 381/361; 381/160; 381/352

(58) Field of Classification Search
USPC ..... 381/355, 313, 361, 160, 352
See application file for complete search history.

(56) References Cited

U.S. PATENT DOCUMENTS 5,103,927 A * 4/1992 Heavener ..... 181/158
6,158,902 A 12/2000 Staat
6,408,080 B1 6/2002 Koizumi
2005/0117769 A1* 6/2005 Kondo ..... 381/355
2008/0232629 A1 9/2008 Akino et al.
2009/0097686 A1 4/2009 Yoshino

FOREIGN PATENT DOCUMENTS

| | | |
|---|---|---|
| GB | 2218303 | 11/1989 |
| JP | 7-43015 | 8/1995 |
| JP | 2005333180 | 12/2005 |
| JP | 2007019693 | 1/2007 |

OTHER PUBLICATIONS

International Search Report for Application No. PCT/EP2010/051459 dated Oct. 8, 2010 (3 pages).
Przybilla et al., "Report on the use of conventional studio microphones or boundary microphones," AMK Berlin, Nov. 21, 1984, pp. 208-221.

* cited by examiner

*Primary Examiner* — Davetta W Goins
*Assistant Examiner* — Amir Etesam
(74) *Attorney, Agent, or Firm* — Michael Best & Friedrich LLP

(57) ABSTRACT

A high directivity boundary microphone (10) is disclosed, build up of a normal unidirectional microphone element (12) with cardioid-directivity behavior. The microphone element (12) is placed on a holder plate (14), with a membrane (16) of the microphone element (12) facing a plane (18) where a holder (20), comprising the holder plate (14) and a holder feet (22), is placed upon. The holder (20) ensures that the microphone element (12) is aligned at an angle (24) of preferably 35° respective to the plane (18). In this position, the microphone element (12) can detect direct sound (26) in a defined speech area (28A, 28B) as well as delayed sound (30) that is reflected at the plane (18) beneath the microphone element (12). Outside the defined speech area (28A, 28B) the sensitivity is strongly reduced.

15 Claims, 2 Drawing Sheets

HIGH DIRECTIVITY BOUNDARY MICROPHONE

STATE OF THE ART

Amplification of the spoken word is necessary on many occasions and should be easy to use and little prone to failure or distortion. Typically, this is solved by placing a microphone on a stem to pick up the voice. Especially in situations where a layman has to use a microphone on its own, acquiring interference-free amplification often proofs difficult. One way to overcome such obstacles is by using a fixed microphone, for example a boundary microphone.

Most boundary microphones follow the format of a condenser element mounted to a boundary plate and covered with a protective screen. The microphone is installed in a low profile manner and lies flat on a desk or floor. Exemplary, one boundary microphone that resembles the state of the art, is US 2009/0097686 A1. This US patent application is the newest out of the boundary microphone family of Audio Technical, Tokyo/JP.

While those microphones have the advantage that the speaker does not have to be in close proximity for good sound reception, their directional characteristics are insufficient.

Only few boundary microphones vary from this basic principle of a flat microphone.

U.S. Pat. No. 6,158,902 discloses a boundary layer microphone with one main direction of response wherein the microphone is equipped with at least one sound tunnel running underneath a plate surface. Such an construction increases the directional characteristics compared to other boundary layer microphones of the aforementioned type, but due to the geometry of the microphone the area where acoustic reception is optimal is limited.

U.S. Pat. No. 6,408,080 B1 relates to a microphone that connects the boundary layer technology with a concave reflector to provide improved sensitivity. The concave reflector may be arranged with respect to a boundary layer creating surface such that the sound waves are concentrated at the boundary layer creating surface. Thus, an intense compression layer is formed proximate to the boundary layer creating surface. Although the size of the area where acoustic reception is optimal is increased compared to U.S. Pat. No. 6,158,902, this microphone possesses a complicated setup, which does not allow for fast and easy assembly or alterations.

DISCLOSURE OF THE INVENTION

The present invention combines the advantageous properties of a boundary microphone, like good surround effect of the sound and no comb filter effect, with the cardioid-directive behavior, with high signal to noise ratio, of a normal unidirectional microphone.

Several approaches have been developed for effectively using a microphone in less-than-ideal acoustic spaces, which often suffer from excessive reflections from one or more of the surfaces (boundaries) that make up the room.

In any room, sound travels to the microphone by two paths: by direct path to the microphone and as a result of being reflected off any hard surface in the room. When the user speaks in front of the microphone, in the speech area, the sound waves go directly to the microphone element but will also be reflected on a flat plane in front of it and redirected to the microphone element. Reflections travel a longer path to the microphone thereby arriving later in time and this can be the cause of multiple phase interactions. Both the direct and delayed sounds combine at the microphone.

At frequencies where the direct and delayed sounds are in-phase (coherent), the signals add together, doubling the sound pressure and boosting the amplitude by 6 dBSPL. This results in a series of peaks in the overall frequency response.

At frequencies where the direct and delayed signals are out-of-phase, the signals would cancel each other, creating a dip or notch in the response. That results in a series of dips in the overall frequency response, creating a comb filter effect, producing unnatural sound.

To solve this problem of peaks and dips in the overall frequency response, it is necessary to shorten the delay of the reflected sound so that it arrives at the microphone at approximately the same time as direct sound does.

In the present invention, this is solved by placing a microphone element extremely close (millimeter range, significantly shorter than the wavelength given by the highest frequency) to the reflective plane. For this purpose the microphone element must be small enough (half an inch or smaller).

This close positioning of the microphone element to the reflective plane and picking up the direct and reflected sound provides a gain of 6 dB. Simplified, compared to a normal microphone with the same microphone element, one can speak at twice the distance with the same signal to noise.

According to the invention, a normal small unidirectional microphone element with cardioid-directivity behavior is placed adjacent to a plane, for example a table, with the microphone element facing the plane. The angle between the microphone element and the plane is preferably 35°. By using a unidirectional microphone element and placing it in a aligned holder, the directional properties of the element will be improved, as the microphone element picks up the direct sound. Additionally, the benefits of the boundary layer technique, as the microphone element also captures the reflected sound, can be gained.

The surface right below the microphone element has a crucial influence on the total performance of the high directivity boundary microphone. When the surface is not smooth, stiff, reflecting and big enough the extra gain can not be reached. The resulting sound can also be colored by absorbed and reflected specific parts in the frequency range.

Because of the extra gain one can use the high directivity microphone on a larger distance without decreasing the signal to noise ratio compared to a normal microphone. When the user speaks on a larger distance he has more flexibility of moving without it being directly audible by the microphone signal. Less amplitude variation will occur by this.

Compared to a speaker in close proximity to a microphone the moving of a speaker on a larger distance to the microphone is less.

Additionally, by using the high directivity boundary microphone no proximity effect can take place on a larger distance. Also this invention never forms an obstruction for the speaker's face.

Both factors, less amplitude variation and no proximity effect, give a big contribution to the speech intelligibility.

DETAILED DESCRIPTION OF THE DRAWINGS

Figure 1:
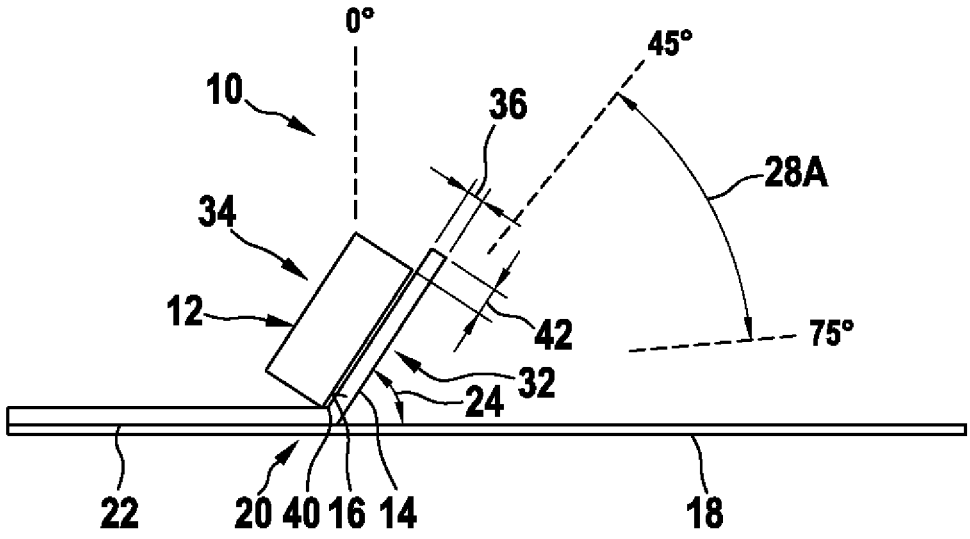
FIG. 1 is a side view of the high directivity boundary microphone and the necessary holder on a plane.

In FIG. 1 a high directivity boundary microphone 10 according to the invention is depicted. A microphone element 12 is placed in a holder plate 14, with a membrane 16 of the microphone element 12 facing a plane 18 where a holder 20, comprising the holder plate 14 and a holder feet 22, is positioned upon. The membrane of the directivity boundary microphone 10 is flush positioned into the holder plate 14 so that the directivity boundary microphone 10 and the holder plate 14 together form one equal surface.

The holder 20, the holder plate 14 and the holder feet 22 can be made of a variety of materials, comprising metals and plastic.

Figure 2:
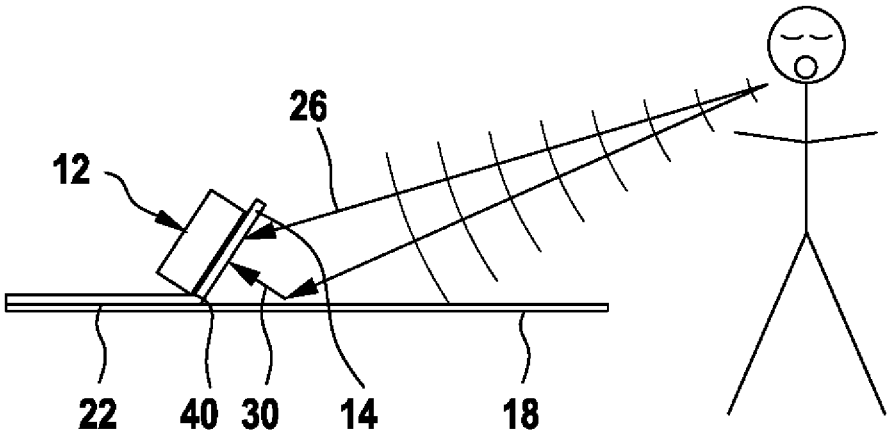
FIG. 2 is s sketch of how the sound waves travel to the microphone element.

The holder 20 ensures that the microphone element 12 is aligned at an angle 24 of preferably 35° respective to the plane 18. In this position, the microphone element 12 can detect direct sound 26 (FIG. 2) in a defined speech area 28A (FIG. 1) and 28B (FIG. 3) as well as delayed sound 30 (FIG. 2) that is reflected at the plane 18 beneath the microphone element 12.

The angle 24 of 35° is optimal for acoustic performances. At higher angles 24, amplitude variations in the frequency response on different vertical speech angles occur as well as a reduced directivity, at smaller angles 24, the cardioid behavior will cancel low frequencies and possible also mid frequencies. In both situations the coloring of the sound will increase.

The microphone element 12 with cardioid-directivity behavior is unidirectional, which is a combination of two microphone types; pressure microphone and velocity microphone. The velocity component is responsible for high rumble sensitivity. Because the microphone element 12 is in close position to the plane 18, the low frequency of rumble noise is on both sides—front 32 and rear 34—of the microphone element 12 and cancels each other. The pressure component in the microphone element 12 ensures that not the whole low frequency response is eliminated.

Preferentially, the holder plate 14 has a thickness 36 of 3 mm and the dimension 42 between the microphone element 12 and an edge 42 of the holder plate 14 is also preferably 3 mm.

Those values are chosen to increase the directivity performance of the small microphone element 12. Through this edge 42 and the thickness 36 of the holder plate 14 the sound will be delayed when it travels from front to rear. The normally poor directivity of a small microphone element 12 can now be improved. The microphone element 12 is placed as close as possible to the corner 40 of the holder 20 as this will reduce the interference behavior at high frequencies. The edge 42 of the holder plate 14 makes the distance between front 32 and rear 34 of the microphone element 12 longer. This increases the directivity of the microphone element 12 from cardioid to hyper cardioid.

A well designed cardioid microphone element has a SPL reduction of −6 dB on the 90 degrees axis compared to the 0 degrees axis. Theoretically, on the 180 degrees axis it does not pickup sound at all. You can reduce the sound pickup at the 90 degrees axis by increasing the path from front to rear. The sensitivity at the 90 degrees axis will be less than −6 dB. An example of this type of microphone is a hyper cardioid microphone. The price that you have to pay is that such a microphone is more sensitive on the rear side.

With the specified dimensions of the holder plate 14 and the microphone element 12 of the invention the sensitivity at the 90 degrees axis is lower than −6 dB and the sensitivity at the rear side is kept as low as possible. Its behavior changes to the direction of hyper cardioid microphone. This overall design plus the boundary gives the microphone the high directivity behavior.

The benefit of the high directivity of the invention is that it has a high sensitivity in the speech area 28A, 28B and much less sensitive outside the speech area 28A, 28B. It picks up the desired spoken word and much less the surrounded disturbing noise. This results in a better speech intelligibility.

It also helps to reduce the moment of acoustical feed back in a total system. A total system is a microphone, an amplifier and a loudspeaker. Acoustical feed back is the moment when the microphone amplifies its own signal picking up from the loudspeaker. The reason is that the high directivity boundary microphone 10 has a higher directivity compared to a normal microphone of the same element.

The plane 18 where the holder 20 with the microphone element 12 is placed upon is crucial for the high directivity boundary microphone performance. The plane 18 must have a smooth flat surface especially right beneath and in front the microphone element 12, so that no diffuse reflection or absorption of sound takes place. For the same reason, the plane must continue for at least 20 cm without large surface interruptions. As the plane reflects and conducts the sound to the microphone element 12 an interruption or a short plane would color the sound.

Figure 3:
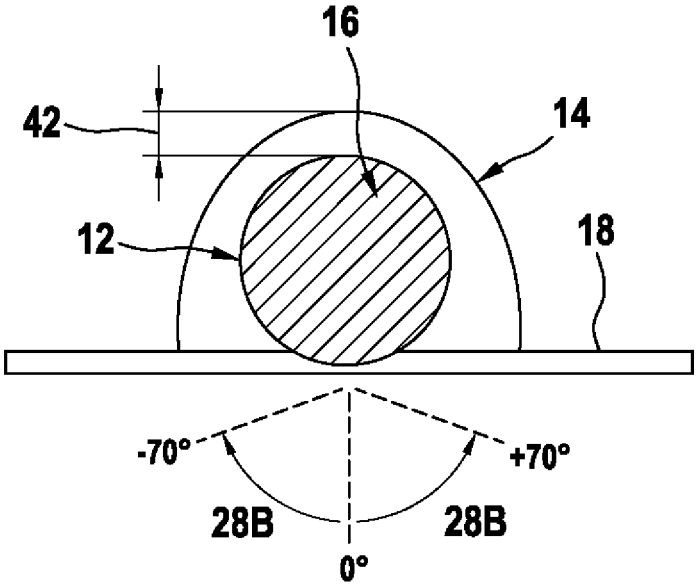
FIG. 3 is a front view of the high directivity boundary microphone positioned on the holder as seen from the users perspective.

FIG. 3 shows a front view of a drawing of one exemplary embodiment of the microphone element 12.

The microphone element 12, which is attached to the holder 20, is surround by the preferably half-cylindrical holder plate 14, which keeps the microphone element 12 in place and serves as protection against mechanical influences.

Figure 4:
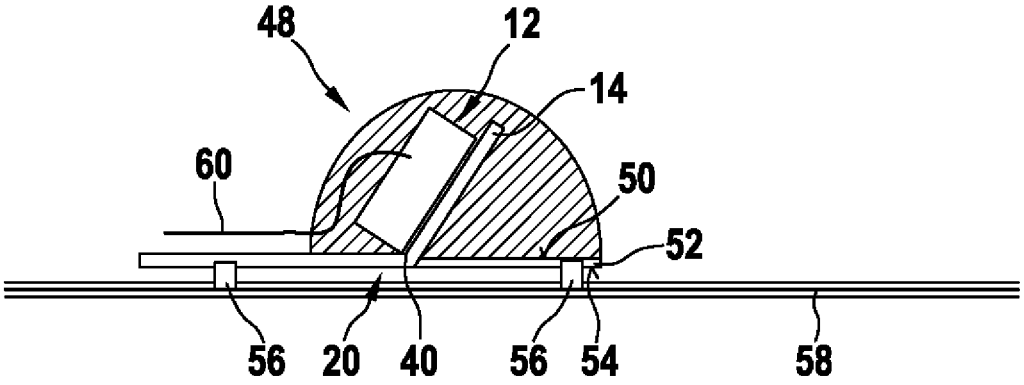
FIG. 4 is one possibility of a practical solution of the high directivity boundary microphone and holder placed under an protective cap.

FIG. 4 depicts one possibility of a practical solution of the high directivity boundary microphone 10 and holder 20 placed under an protective cap 48.

The microphone element 12 is placed on the holder plate 14 as described previously. Instead of positioning the holder 20 directly on the plane 18, the holder 20 is placed on a upper side 50 of a smooth and fixed designed reflecting plane 52. On a bottom side 54, the reflection plane 52 is equipped with at least one vibration absorber 56 and than placed on the plane 18, for example a table 58. The vibration absorber 56 is made of an elastic material, for examples rubber, synthetic elastomers or foam/gel padding, and provides an decoupling effect, which decreases rumbling and vibration noise. As sound is nothing more than a pressure wave, eliminating vibrations that are not caused by the source that is necessary to be amplified is crucial for a good signal to noise ratio.

The use of the uni-directional microphone element and its positioning on the reflecting plane 52 gives a cancelation for the low frequency part. For the rumble noise it is a positive contribution. But also the lowest part of the speech frequency range will be reduced a bit. An amplification of a small part of the frequency range can fix this reduction.

The sound quality of this practical solution can be improved by using a octave width filter with a center frequency of 200 Hz. To boost this octave with a few dB the speech signal gets back its suppressed low frequencies. Below the boosted 200 Hz octave the low frequency cancelation becomes active again. With this small equalizing correction one simultaneously obtains the low frequencies of the speech signal and the cancelation of rumbling noise.

The holder 20 and the microphone element 12 as well as any connection wires 60, for example for signal transduction and power supply, are placed underneath an protecting cap 48, which is preferably an hemisphere. The protecting cap must be as open as possible for the right acoustical performance and strong enough for protecting the microphone.

The reflective plane 52 is made of a material with a very smooth, stiff and not absorbent surface as those materials can reflect the sound waves. Otherwise, if the frequencies are absorbed or dampened, the 6 dBSPL increase described above will not occur. Preferably iron is chosen, as this metal is additionally very cost-effective and easy processible.

As can be seen in FIG. 4, the high directivity boundary microphone 10 according to the invention can be equipped with a reflecting plane 52 that makes it possible to use the high directivity boundary microphone 10 also on planes with less ideal surfaces, like carpet or gaps in the plane, as the reflection plane 52 assumes the tasks of the plane 18.

What is claimed is:

1. A high directivity boundary microphone (10) comprising at least one unidirectional microphone element (12) and a holder (20), the holder comprising a holder plate (14) and a holder foot (22), the microphone element (12) being positioned flush into the holder plate (14), wherein the holder (20) is placed on a plane (18), the angle (24) between the holder plate (14) and the plane (18) being between 30° and 40°, and the microphone element (12) being placed as close as possible to a corner (40) formed by the holder plate (14) and the plane (18), wherein the holder plate (14) is dimensioned so that sound will be delayed when it travels from front to rear such that the directivity of the at least one microphone element (12) is increased.

2. The high directivity boundary microphone (10) according to claim 1, characterized in that the at least one microphone element (12) is facing the plane (18).

3. The high directivity boundary microphone (10) according to claim 1, characterized in that the angle (24) between the holder plate (14) and the plane (18) is 35°.

4. The high directivity boundary microphone (10) according to claim 1, characterized in that the at least one microphone element (12) and the holder (20) are placed on a reflection plane (52).

5. The high directivity boundary microphone (10) according to claim 4, characterized in that the reflection plane (52) is equipped with at least one vibration absorber (56) made of elastic material comprising rubber, synthetic elastomers or foam/gel padding.

6. The high directivity boundary microphone (10) according to claim 1, characterized in that the at least one microphone element (12) and the holder (20) are surrounded by a protection cap (48).

7. The high directivity boundary microphone (10) according to claim 4, characterized in that the reflection plane (52) is made of iron.

8. The high directivity boundary microphone (10) according to claim 2, characterized in that the angle (24) between the holder plate (14) and the plane (18) is 35°.

9. The high directivity boundary microphone (10) according to claim 8, characterized in that the at least one microphone element (12) and the holder (20) are placed on a reflection plane (52).

10. The high directivity boundary microphone (10) according to claim 9, characterized in that the reflection plane (52) is equipped with at least one vibration absorber (56) made of elastic material comprising rubber, synthetic elastomers or foam/gel padding.

11. The high directivity boundary microphone (10) according to claim 10, characterized in that the at least one microphone element (12) and the holder (20) are surrounded by a protection cap (48).

12. The high directivity boundary microphone (10) according to claim 11, characterized in that the reflection plane (52) and the protection cap (48) are made of iron.

13. The high directivity boundary microphone (10) according to claim 1, wherein the holder plate (14) has a thickness of 3 millimeters.

14. The high directivity boundary microphone (10) according to claim 1, wherein a dimension between the microphone element (12) and an edge of the holder plate (14) is 3 millimeters.

15. The high directivity boundary microphone (10) according to claim 2, wherein a membrane (16) of the microphone element (12) faces the plane (18) when the holder (20) is placed on the plane (18).

* * * * *